United States Patent [19]

Pira et al.

[11] 3,942,696

[45] Mar. 9, 1976

[54] WEB GUIDING APPARATUS

[75] Inventors: Camille Francois Pira, Edegem; Joseph Irma DeRoeck, St. Katelijne-Waver, both of Belgium

[73] Assignee: AGFA-GEVAERT, N.V., Mortsel, Belgium

[22] Filed: Jan. 29, 1975

[21] Appl. No.: 545,228

[30] Foreign Application Priority Data

Jan. 30, 1974 United Kingdom ..... 4394/74

[52] U.S. Cl. ..... 226/21; 226/95

[51] Int. Cl.[2] ..... B65H 25/26

[58] Field of Search ..... 226/15, 18, 21, 22, 23, 226/95

[56] References Cited

UNITED STATES PATENTS

| | | | |
|---|---|---|---|
| 3,286,895 | 11/1966 | Poumakis | 226/95 |
| 3,330,456 | 7/1967 | Umstott | 226/23 |
| 3,489,325 | 1/1970 | Epstein | 226/95 X |

*Primary Examiner*—Richard A. Schacher
*Attorney, Agent, or Firm*—William J. Daniel

[57] ABSTRACT

Apparatus for controlling lateral divergence or displacement of a web from its true path, which requires contact of its rollers with one face only of the web, and which does not impose deflection of the path of the web.

11 Claims, 4 Drawing Figures

WEB GUIDING APPARATUS

The present invention relates to an apparatus for correcting the lateral divergence or displacement of a travelling air-impervious web from its true path.

In many operations where web material is handled, the web must travel considerable distances before it is finally re-rolled, or other disposition of the web is finally provided for, and during its travel, one or more operations on the web may take place.

For instance, a coating, examining, printing, laminating or tentering operation may be performed on the web many meters from the unwind roll. It is therefore imperative that the travelling web be properly guided at the operational points in the web's travel. In cases wherein the operation on the web takes place at a point remote from the unwind roll, the position of the web at the place of operation cannot accurately be controlled by the shifting of the unwind roll.

In operations wherein a web is compelled to travel a lengthy path, there are several contingencies which might cause the web to deviate from a perfectly straight line of travel, called hereinafter "the true web path". A slackening of the web's tautness might well make it shift laterally. Such slackening might be caused by bearing wear in the web supporting roll shafts or by web material stretch. A slight variation in web thickness or in its coating on either side of its longitudinal center line might well cause the web to creep towards the thicker or tighter side of the web.

Web guiding apparatus are known which comprise several free rotatable rollers mounted in parallel on a frame which is movable with respect to the true web path. The web is wrapped about the several rollers to effect a substantial frictional engagement therewith. Since the described apparatus involve frictional contact of both the web faces with roller surfaces, these apparatus are unsuited for correcting the path of webs which have been provided with a wet coating or the like on one side.

Further there are known web guiding apparatus which comprise one movable roller only. A usual angle of wrap in such apparatus amounts to 30 angular degrees, so that in consequence the plane of travel of the leaving span of the web considerably differs from that of the entering span of the web. Whereas such difference puts no problems in the handling of a dry web since the web may be pulled with its opposite side over one or more additional rollers to restore the initial direction or plane of travel of the web, the handling of webs which do not tolerate frictional contact with one face raises difficulties and requires a careful design of the web path throughout an installation to take account of the impossibility to deflect the web into the direction of said one face.

It is the aim of the present invention to provide an apparatus for correcting the lateral divergence of a travelling web from its true path, which requires frictional contact with one web face only, and which apparatus yet does not necessitate a substantial deflection of the plane wherein the web is moving.

More in particular, the invention aims at providing such apparatus wherein the leaving span of the web may be located in the same plane as the entering span of the web.

According to the present invention there is provided apparatus for guiding a longitudinally travelling web so as substantially to maintain a predetermined line of travel thereof between two points, said apparatus comprising at least two parallel rollers extending laterally across the intended path of the web and so as to support the web at one side thereof at a zone between said points, which rollers are mounted so that the angle between their axes and said line of travel, in the projected plane of the web, can be varied, and means which in operation of the apparatus serves to produce a difference in the air pressures on opposite sides of the web at the place where it bridges said rollers, thereby to cause successive portions along the length of the web to follow a path which dips between said rollers.

By virtue of the fact that the web dips between the rollers the web conforms to portions of the peripheral surfaces of the rollers instead of making line contact with them as it would do if the web were in a plane tangential to the rollers. In other words the web wraps around portions of the rollers and in consequence the frictional engagement of the web is substantial. The angle of wrap, i.e. the angle subtended by the portions of the roller peripheries against which the web is pressed, may be, e.g., of the order of 20°. As hereinafter referred to the web need not be in direct contact with the rollers. There may be an intervening support member or members, e.g. a supporting belt or band or a plurality off supporting bands at spaced positions across the width of the web. Generally speaking the apparatus is intended for guiding air-impervious or substantially air-impervious webs.

Apparatus according to the invention is used as follows. If the web starts to deviate from its intended line of travel between the two points referred to, the line of travel is corrected by swinging the rollers to a different angle relative to the intended line of travel of the web. For reasons hereafter given such a change in the disposition of the rollers results in a change in the actual line of travel of the web. Adjustment of the direction of the rollers can be performed automatically in dependence on signals from a web position sensor and apparatus according to the invention is preferably constructed to achieve such automatic guidance of the web.

The rollers are preferably mounted so that they are freely rotatable and are driven by the web itself.

In order to achieve a very satisfactory guidance of the web responsive to the swinging movements of the rollers, it has been found to be necessary to have a sufficient free length of web on the approach side of the rollers. In other words the distance between such rollers and the upstream point at which the web is supported should not be too short. Preferably such distance is at least 1.5 times and more preferably at least 2 times the length of a roller.

In preferred embodiments therefore, apparatus according to the invention for guiding a web over a path between two points comprises at least two freely rotatable parallel rollers for supporting the web at one side thereof at a zone between said points, which rollers are mounted for swinging movement so that the angle between their axes and said line of travel, in the projected plane of the web, can be varied, and means for producing an air-pressure difference which is capable of causing a web (which in the absence of such air-pressure difference would be pulled in a tangent plane to said rollers) to follow a path which curves into the space between said rollers thereby to increase the angle of wrap to effect a substantial frictional engagement of the web with the rollers or with an intervening support and means for determining the path of travel of the web towards said rollers so that the length of the free entering span of the web amounts to at least twice the length of a roller.

The term "air-impervious webs" used in the present specification covers, inter alia, webs made from materials such as for instance polyethylene terephthalate, polypropylene, polyethylene, triacetate or paper, and woven and non-woven fabrics which are air-impervious to a sufficient extent to make them respond to the solicitation by the described air-pressure difference.

Preferred embodiments of the invention are as follows. The means for producing an air-pressure difference comprises an air-box or pleum which is situated between said rollers and which has an opening that is turned towards the said tangent plane to the rollers, and means for establishing a reduced pressure in said box.

The dimension of the opening of the air-box that runs parallel to the axis of the rollers preferably is at least 10% smaller than the width of a web to be controlled.

The rollers of the apparatus are mounted so that, in addition to their angular position, also their axial position may be altered.

The invention will hereinafter be described with reference to the accompanying drawings wherein.

Figure 1:
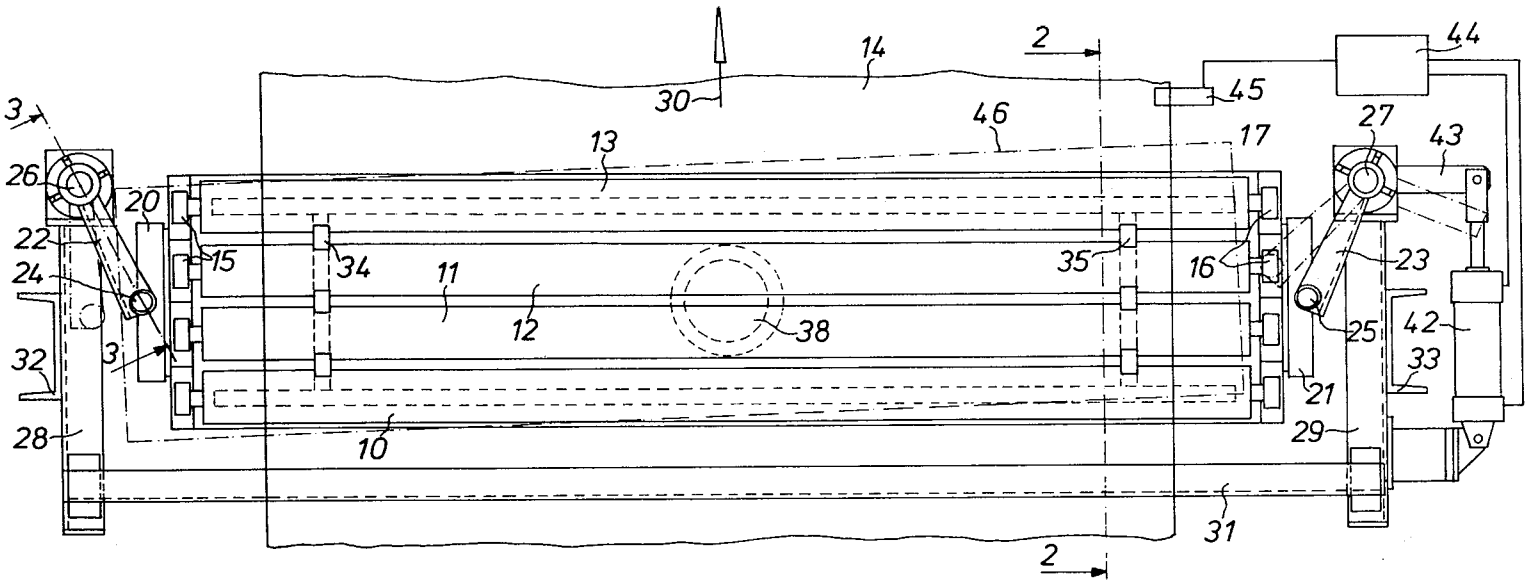
FIG. 1 is a top view of an embodiment of the apparatus according to the present invention.
Figure 3:
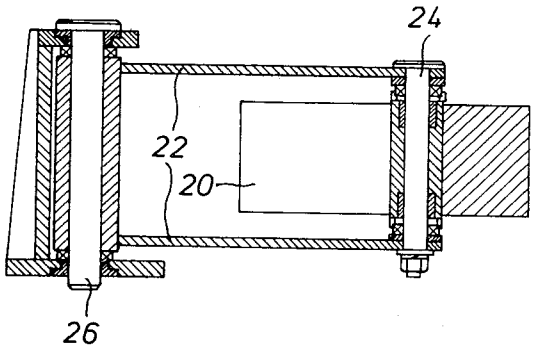
FIG. 3 is a section on line 3—3 of FIG. 1.
Figure 2:
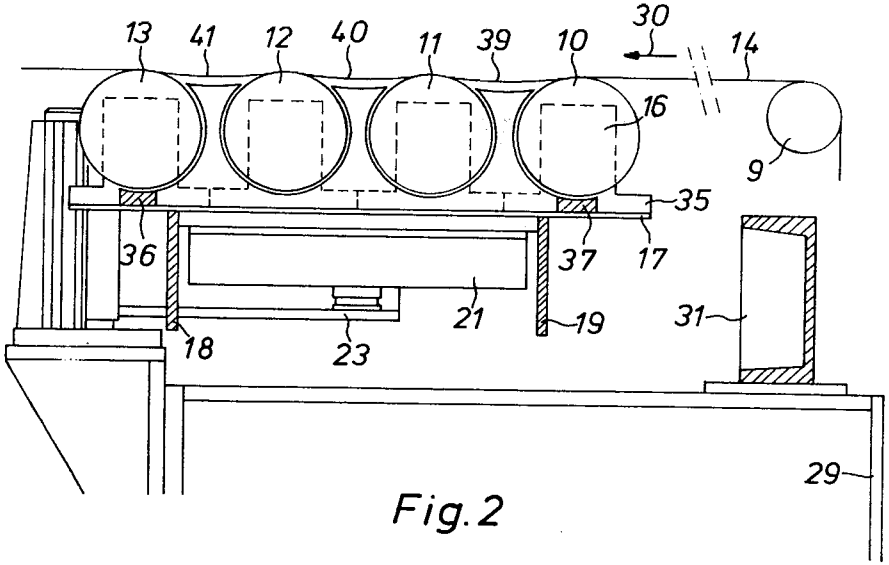
FIG. 2 is a section on line 2—2 of FIG. 1.

Referring to FIGS. 1 and 2, the apparatus comprises four parallel rollers 10, 11, 12 and 13 over which is pulled a web 14 the lateral position of which must be controlled. The web is advanced in the direction illustrated by the arrow 30. The web 14 is fed to the roller 10 via a freely rotatable roller 9 on a fixedly mounted shaft, which determines a plane of travel for the free-entering span of the web running approximately parallel with a plane that passes through the axes of the four rollers. Further there is provided means, not shown, for pulling the web from the apparatus in a plane that coincides with the plane wherein the web is fed to the apparatus.

The rollers 10, 11, 12 and 13 are mounted for free rotation in bearings 15 and 16 which are fitted to a rectangular base plate 17. The base plate is stiffened by longitudinal stringers 18 and 19. At the lateral extremities of the base plate there are provided short beams 20 and 21 which are pivotally connected to pairs of arms 22 and 23, by means of vertical pins 24 and 25. The arms may pivot about vertical pins 26 and 27 which are fixedly mounted on two horizontal beams 28 and 29 which run parallel to each other at both lateral sides of the apparatus and which are supported by upstanding columns 32 and 33 which are anchored in the floor. A beam 31 rigidly connects the beams 28 and 29 with each other and is intended for stiffening the construction.

Between each pair of adjacent rollers there is formed a vacuum box with an opening at its top side. The air boxes are formed by two lateral walls 34 and 35 which are fitted at their lower side to the base plate 17 and which extend upwardly betwen the rollers. It may be seen in particular in FIG. 2 that the walls comprise portions which closely surround the peripheries of the rollers and which terminate at the upper side at a level which is situated somewhat below the level determined by a tangent plane to the rollers. The two outer air boxes are further closed by two ledges 36 and 37 which are fitted to the base plate and which have a concavely curved upper face that is closely spaced from the periphery of the corresponding rollers 13 and 10.

A central opening 38 in the base plate is connected via a flexible conduit to a device (not shown) for creating an underpressure in the air box.

A hydraulic cylinder 42 is connected via a lever 43 to the pin 27 of the apparatus and enables to rotate said pin in either direction under the control of a controller 44 which is responsive to the signal from a web edge sensor 45.

In the operation of the apparatus, a web which is being pulled over the apparatus as illustrated in FIG. 2, is passing over the rollers while following slightly curved paths as indicated by the numerals 39, 40, and 41. These curvatures in the web path are caused by the air-pressure difference which results from the atmospheric pressure which prevails at the upper side of the web and the reduced pressure which is produced in the air box at the lower side of the web and which tends to displace the web portions extending between the successive rollers towards the nip of the rollers. (As will be seen the rollers are not in contact with each other).

Since a moving web which is in sufficient frictional contact with a roller always endeavours to contact the roller at a position wherein the longitudinal direction of the web is strictly normal to the roller axis, it will be understood that swinging of the base plate will cause the web to shift laterally in an attempt to find a position wherein the roller may yet be approached perpendicularly. For instance, a tilting of the base plate as illustrated by the position 46 in broken lines in FIG. 1, will cause the entering web to move to the right-hand side of the figure.

The angular displacement of the rollers preferably occurs automatically under the control of a controller which itself responds to the signal which is produced by a sensing head which senses the lateral position of a web as illustrated by the edge sensor 45 and the controller 44, respectively. The controller may be a servo-valve which controls the flow of pressurized hydraulic fluid to the hydraulic cylinder 42, and the correction rate may be directly proportional to the material's lateral error at the sensing head.

The following example illustrates the apparatus described hereinbefore.

Length of the rollers: 2000 mm.
Diameter of the rollers: 95 mm.
Axial spacing of the rollers: 120 mm.
Distance between the lateral walls 34 and 35: 1500 mm.
Gap between the lateral walls and the roller peripheries: 1 to 2 mm.
Distance between the upper edges of said walls and a tangent plane to the rollers: 8 mm.
Width of the web: 1700 mm.
Web material: polyethylene terephthalate of a thickness of 0.18 mm.
Web tension: 30 kg.
Underpressure in the air box: 30 to 40 mm of $H_2O$.
Maximum deflection of the web from a tangent plane to the rollers towards the nip of the rollers: 3 mm.

Approximate contact angle of each of the rollers 11 and 12 with the web: 20°.

Length of the free entering span of the web extending between the rollers 9 and 10: 4.5 m.

It will be understood that the invention is not limited to the described apparatus.

The apparatus may comprise more or less than four rollers, but at least two rollers.

The planes werein the entering and leaving spans of the web are situated need not necessarily coincide, and thus the web may be fed to and pulled from the apparatus in planes that are inclined downwardly as compared with the planes illustrated in FIG. 2.

The pivotal movement of the rollers may occur by swinging the base plate on which the rollers are mounted about a central vertical axis, rather than by displacing the plate by two arms as illustrated. It should be noted, however, that the correcting effect of suchlike device is slower than that which may be obtained by the embodiment illustrated in the FIG. 2.

The pivotal movement of the rollers may also result from a sliding movement of the lateral extremities of the base which supports the rollers, in directions which intersect each other at the longitudinal center line of the apparatus, as disclosed in U.S. Pat. No. 2,797,091.

The air-pressure difference may also be established by an overpressure of air at the web side which is remote from the rollers, or by a combination of an over- and underpressure.

There may be provided an air-pervious endless belt about the set of rollers covering a lateral distance which extends between the two lateral extremities of the air-box, thereby to support the web and to prevent that upon accidental unbalance between the web tension and the air-pressure difference, the web should be pulled too far towards the nip between the rollers. Alternatively, several narrower air-pervious or air-impervious belts which are spaced from each other in the axial direction of the rollers may be used.

The air-box must not necessarily extend uninterruptedly according to the width of the web and in an alternative embodiment the air-box may be replaced by several smaller units which are spaced in the axial direction of the rollers and which may form separate air-pockets for establishing air-pressure differences acting on limited areas of the web surface that are spaced from each other in the transverse direction of the web.

Figure 4:
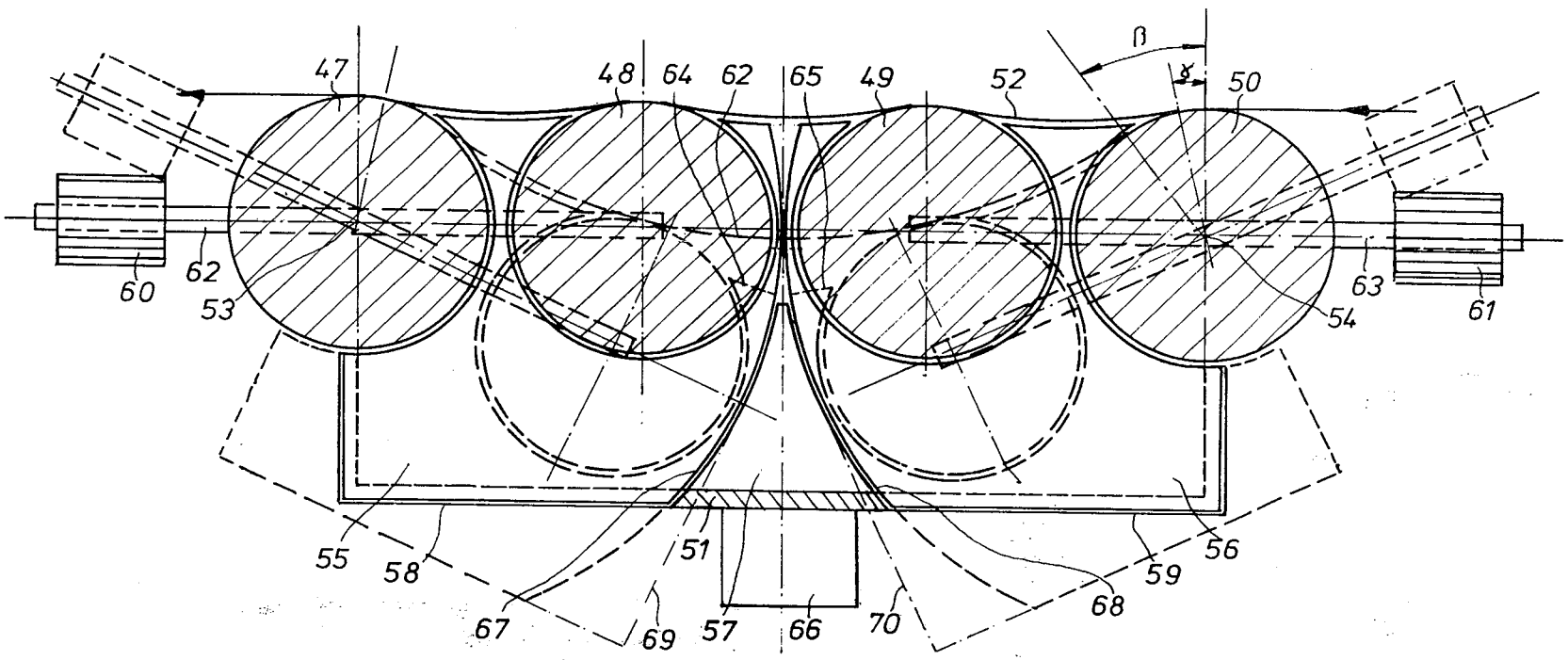
FIG. 4 is a diagrammatic cross-sectional illustration of another embodiment of an apparatus according to the invention.

Referring to FIG. 4 wherein an alternative embodiment of the apparatus, according to the invention is illustrated, the apparatus comprises four freely rotatable rollers 47, 48, 49 and 50 which are mounted in closely parallel relation and underneath which a vacuum box 51 is provided. The rollers and the vacuum box are mounted by means, not shown, for angular or angular and axial displacement as described hereinbefore in order to correct the path of an air-impervious web which is running over the rollers. The outer rollers 47 and 50 have a fixed position whereas the inner rollers 48 and 49 are mounted by means, not illustrated, for pivotation about the axis 53, respectively 54 of the corresponding adjacent outer rollers 47 and 50. The lateral boundaries which determine the effective vacuum box width, and which can be compared with the walls 34 and 35 of the apparatus described hereinbefore, are formed by the walls 55 and 56 shown in drawn lines, which have concavely curved edges at the upper end which closely surround the corresponding portions of the peripheries of the rollers, and convexly curved edges 67 and 68 which face the concavely curved edges of a generally triangular upstanding wall member 57. The walls 55 and 56 are mounted for pivotation together with the corresponding rollers 48 and 49 about the axis 53 and 54. In the mentioned way, the rollers 48 and 49, and the walls 55 and 56 may take an inclined extreme lower position as is illustrated in broken lines in the figure.

The described pivotal displacement of the walls 55 and 56 is made possible by slots 58 and 59, in the bottom and side walls of the vacuum box, through which the walls 55 and 56 may pass with some small clearance.

In the inoperative position of the apparatus, the rollers take a position as shown in drawn lines. This position is obtained by masses 60 and 61 which bias through arms 62 and 63 the pivotal rollers 48 and 49 and the corresponding walls 55 and 56. The path which would be followed by a web if the mechanism would be blocked and an air-pressure difference yet be applied, is shown by the uninterrupted line 52. It may be seen that the angle over which the web is wrapped about the rollers 47 and 50 is $\alpha$, and in consequence the angle of wrapping of the web about the rollers 48 and 49 will be 2 $\alpha$. In normal operation of the apparatus when an underpressure is established through a connection 66 which may be situated about centrally of the vacuum box, the web will follow a deflected path 62 shown in broken lines, which results from an equilibrium between the bias of the masses 60 and 61, the pressure difference acting on the web, and the longitudinal tension in the web. The upper extremities 64 and 65 of the walls 55 and 56 are in the deflected position of the web more remote from the underside of the web than they are in the non-deflected web position and thus the section of a leakage opening for the underpressure in the vacuum box is increased. The described increase may have a self-stabilising effect on the apparatus since the variation of the underpressure in the vacuum box is inversely proportional to the deflection of the rollers 48 and 49.

The wrapping angle of the web about the rollers 47 and 50 in the operative position of the apparatus is indicated by $\beta$, the wrapping angle about the rollers 48 and 49 being almost zero. It may be seen that the angle $\beta$ is considerably greater than the angle $\alpha$ and in consequence much higher correcting forces may be exerted by the apparatus on the web since the frictional force between a web and a roller is an exponential function of the wrapping angle of such web about such roller.

In an alternative embodiment of the apparatus which has been described hereinbefore the upstanding wall member 57 may be omitted and the walls 55 and 56 may have rectangular edges as illustrated by the dash and dot lines 69 and 70 rather than curved edges such as 67 and 68. In the mentioned way, the edges 69 and 70 may define a narrow gap in the upper position of the rollers 48, 49 and the walls 55 and 56, which gap increases automatically in section as the rollers 48 and 49 are lowering and the edges 69 and 70 of the walls 55 and 56 are swinging accordingly away from each other. The self-stabilising effect which is obtained in the mentioned way by the leakage opening of varying section, may exceed the effect of the arrangement described hereinbefore.

We claim:

1. Apparatus for correcting the lateral divergence or displacement of a travelling air-impervious web from an intended line of longitudinal travel between two points, said apparatus comprising:

a series of at least two freely rotatable parallel rollers for supporting the web at one side thereof at a zone between said points, said rollers being mounted for pivotable movement so that the angle between their axes and said line of travel, in the projected plane of the web, can be varied, a freely rotatable stationary roller mounted upstream from said series of pitotable rollers, the distance between said stationary roller and the adjacent roller of the series of pivotable rollers being at least equal to 1.5 times the length of a roller; and means for producing on one side of said roller series an air-pressure difference capable of urging a web, which in the absence of such air-pressure difference would be pulled in a tangent plane to said rollers, to follow a path which curves into the space between said pivotable rollers thereby to increase the angle of wrap to effect a substantial frictional engagement of the web with said pivotable rollers, and means for confining said air pressure difference to substantially the length of web within said roller series whereby said web follows a rectilinear path between the stationary roller and the series of pivotable rollers.

2. Apparatus according to claim 1 wherein said means for producing an air-pressure difference comprises means for defining an air-box located between said series of pivotable rollers, said box having an opening directed towards said tangent plane to the rollers, and means for establishing a reduced air-pressure in said box.

3. Apparatus according to claim 2, wherein said means for determining an air-box comprises at least two lateral walls extending along the sides of said series of pivotable rollers and spaced from each other in the axial direction of said rollers over a distance which is smaller than the length of said rollers, and a wall interconnecting the ends of said at least two walls which are opposite to said box opening in a plane that runs generally parallel to a plane passing through the axis of said rollers.

4. Apparatus according to claim 3, wherein the distance over which said lateral walls are spaced from each other is at least 10 % smaller than the width of the web to the controlled.

5. Apparatus according to claim 3, wherein the extremities of said lateral walls which face the said pivotable rollers are concavely curved about an axis that coincides with the axis of the corresponding rollers, and define a narrow gap with the peripheries of said rollers.

6. Apparatus according to claim 1, wherein said pivotable rollers are mounted so that, in addition to the altering of the angular position of the rollers, also the axial position of the rollers may be altered.

7. Apparatus according to claim 1, wherein said pivotable roller series comprises at least three rollers, the axis of said rollers being situated in one plane.

8. Apparatus according to claim 1 wherein said pivotable roller series comprises four parallel rollers which are located in closely spaced relation in the direction of travel of the web, each of the two inner rollers being arranged for bodily pivoted displacement about the axis of the corresponding outer roller.

9. Apparatus according to claim 8, wherein said inner rollers are biased for movement towards a position which is about in line with the two outer rollers in the absence of an air-pressure difference applied to a web supported on the rollers.

10. Apparatus according to claim 9, wherein the lateral boundaries which determine the effective air box width are formed by walls which extend between each corresponding outer and inner roller, and which are arranged to pivot about the axis of the outer roller.

11. Apparatus according to claim 10, wherein said walls may be displaced through corresponding slots in the bottom and side walls of the air box.

* * * * *